US006850246B2

(12) United States Patent
Hosotani

(10) Patent No.: US 6,850,246 B2
(45) Date of Patent: Feb. 1, 2005

(54) SCREEN DISPLAY UNIT CAPABLE OF DISPLAYING GREATER NUMBER OF COLORS ON THE SAME SCREEN

(75) Inventor: Osamu Hosotani, Hyogo (JP)

(73) Assignees: Renesas Technology Corp., Tokyo (JP); Mitsubishi Electric System LSI Design Corporation, Itami (JP)

( * ) Notice: Subject to any disclaimer, the term of this patent is extended or adjusted under 35 U.S.C. 154(b) by 264 days.

(21) Appl. No.: 09/879,172

(22) Filed: Jun. 13, 2001

(65) Prior Publication Data

US 2002/0130879 A1 Sep. 19, 2002

(30) Foreign Application Priority Data

Jan. 16, 2001 (JP) ..... 2001-008194

(51) Int. Cl.[7] ..... G09G 5/02

(52) U.S. Cl. ..... 345/589; 345/593; 345/601; 345/602; 345/549; 345/531

(58) Field of Search ..... 345/549, 602, 345/601, 589, 593, 531

(56) References Cited

U.S. PATENT DOCUMENTS 4,443,794 A * 4/1984 Sakurai ..... 345/467
4,490,797 A * 12/1984 Staggs et al. ..... 345/549
4,789,855 A * 12/1988 Ozeki ..... 345/601
4,942,389 A * 7/1990 Hinami ..... 345/549
4,991,120 A * 2/1991 Vaiana ..... 345/602
5,539,431 A * 7/1996 Nishioka et al. ..... 345/601
5,949,409 A * 9/1999 Tanaka et al. ..... 345/549
6,373,497 B1 * 4/2002 McKnight et al. ..... 345/602

FOREIGN PATENT DOCUMENTS

JP A 63-106791 5/1988
JP A 63-305387 12/1988

* cited by examiner

*Primary Examiner*—Matthew C. Bella
*Assistant Examiner*—Po-Wei Chen
(74) *Attorney, Agent, or Firm*—Burns, Doane, Swecker & Mathis, L.L.P.

(57) ABSTRACT

A screen display unit includes a display RAM to which a CPU writes palette codes corresponding to character codes, and a selector for selecting display color data read from one of two color palettes on a character code by character code basis in response to the palette codes read from the display RAM. The selector can select one of the two color palettes on a character code by character code basis, thereby making it possible to carry out display in a greater number colors on the same screen than the number of colors indicatable by the display color codes stored in the display RAM without increasing the capacity of a font data memory.

9 Claims, 8 Drawing Sheets

SCREEN DISPLAY UNIT CAPABLE OF DISPLAYING GREATER NUMBER OF COLORS ON THE SAME SCREEN

BACKGROUND OF THE INVENTION

1. Field of the Invention

The present invention relates to a screen display unit for displaying characters such as a channel number on a television screen.

2. Description of Related Art

FIG. 9 is a block diagram showing a configuration of a conventional screen display unit. In this figure, the reference numeral 1 designates a CPU for writing character codes into a display RAM which will be described later, and for writing control data into a register; and 2 designates a data and address bus.

The reference numeral 3 designates a display RAM to which the CPU 1 writes character codes to be displayed at individual positions on a screen consisting of n row by m column character array; and 4 designates a font data memory for prestoring font patterns corresponding to the character codes, and display color codes of individual dots constituting the font patterns, and for reading display color codes constituting the font patterns corresponding to the character codes read from the display RAM 3. The reference numeral 5 designates a color palette for prestoring display color data (RGB allocation information) corresponding to display color codes, and for reading the display color data corresponding to the display color codes read from the font data memory 4; and 6 designates a color palette for prestoring display color data that correspond to the display color codes and differ from the display color data stored in the color palette 5, and for reading the display color data corresponding to the display color codes read from the font data memory 4.

The reference numeral 7 designates a register into which the CPU 1 writes control data; 8 designates a selector for selecting the display color data read from the color palette 5 or 6 in response to the control data written in the register 7; 9 designates DA converters provided for individual RGB signals for converting the digital display color data selected by the selector 8 to analog voltages; and 10 designates an output terminal. The reference numeral 11 designates a timing generator for generating, from the horizontal and vertical synchronization signals and a screen display clock signal, timing signals that are supplied to the components from the display RAM 3 to the DA converter 9, and are needed for screen display control.

Next, the operation of the conventional screen display unit will be described.

In the screen display unit as shown in FIG. 9, the CPU 1 writes a character code array to be displayed into the display RAM 3 via the bus 2 in advance, and writes the control data indicating which one of the color palettes 5 and 6 is to be selected into the register 7 via the bus 2. The operation clock signal of the CPU 1 is asynchronous to the timing signals generated by the timing generator 11 to operate the components from the display RAM 3 to the DA converter 9, and is slower than the timing signals.

The display RAM 3 reads the character codes written in synchronization with the timing signals, and supplies them to the font data memory 4. The font data memory 4 reads the display color codes of the individual dots constituting the font patterns corresponding to the character codes. The color palettes 5 and 6 store the different display color data in advance, and read the display color data corresponding to the display color codes that are read from the font data memory 4.

On the other hand, in response to the control data written into the register 7 by the CPU 1, the selector 8 selects the display color data read from the palette 5 or 6. The DA converters 9 convert the digital display color data selected by the selector 8 into analog voltages to be supplied to the output terminal 10.

Since the conventional screen display unit is configured as describe above, it can select $2^n$ pieces of display color data from the color palette 5 when the display color codes designating the colors of the individual dots consist of n bits in the font data memory 4. Although the number of colors can be increased with the bit length of the display color codes, this will increase the bit length per dot, and hence the capacity of the font data memory 4, and by extension the cost of the screen display unit itself. With the current state of the art, the number of display colors is doubled by installing two color palettes with different display color data such as the color palettes 5 and 6, and by switching the control data of the register 7 on a screen by screen basis (at every vertical synchronization signal interval) by the CPU 1.

The conventional system, however, cannot switch between the color palettes 5 and 6 at a high speed within the same screen interval because the processing cycle of the CPU 1 is slower than and asynchronous to the screen display operation. As a result, the conventional system has a problem of being unable to increase the number of colors displayed on the same screen.

SUMMARY OF THE INVENTION

The present invention is implemented to solve the foregoing problem. It is therefore an object of the present invention to provide a screen display unit capable of increasing the number of colors displayed on the same screen without increasing the capacity of the font data memory.

According to a first aspect of the present invention, there is provided a screen display unit comprising: a display information memory to which a central processing unit writes selection information corresponding to character information; a font data memory that stores display color information corresponding to the character information in advance, and reads display color information constituting font information corresponding to the character information read from the display information memory; a plurality of RGB allocation information memories that store different RGB allocation information corresponding to the display color information in advance, and read RGB allocation information corresponding to the display color information read from the font data memory; a selector for selecting the RGB allocation information read from one of the plurality of RGB allocation information memories on a character information by character information basis in response to the selection information read from the display information memory; and a timing signal generator for generating timing signals supplied to the display information memory, the font data memory, the plurality of RGB allocation information memories, and the selector.

According to a second aspect of the present invention, there is provided a screen display unit comprising: a display information memory to which a central processing unit writes first selection information corresponding to character information, and display color information corresponding to the character information; a first font data memory that stores font information and display color information corresponding to the character information in advance, and reads display color information representing individual dots constituting font information corresponding to the character information read from the display information memory; a second font data memory that stores font information corresponding to the character information in advance, and reads font information corresponding to the character information read from the display information memory; a composition circuit for combining the font information read from the second font data memory with the display color information read from the display information memory to output display color information on a font information by font information basis; a first selector for selecting one of the display color information output from the first font data memory and the display color information output from the composition circuit, in response to second selection information supplied from the central processing unit; a plurality of RGB allocation information memories that store different RGB allocation information corresponding to the display color information in advance, and read RGB allocation information corresponding to the display color information selected by the first selector; a second selector for selecting, in response to the second selection information fed from the central processing unit, one of the first selection information that is read from the display information memory and third selection information that is fed from the central processing unit; a third selector for selecting the RGB allocation information read from the plurality of RGB allocation information memories on a character information by character information basis when the second selector selects the first selection information, and for selecting the RGB allocation information read from the plurality of RGB allocation information memories on a screen by screen basis when the second selector selects the third selection information; and a timing signal generator for generating timing signals supplied to the display information memory, the first and second font data memories, the composition circuit, the first to third selectors, and the plurality of RGB allocation information memories.

Here, the RGB allocation information memories may comprise: a first RGB allocation information memory in which equal resolution is assigned to respective RGB signals for storing the RGB allocation information; and a second RGB allocation information memory in which the RGB allocation information is monochromatic, and has a higher resolution than the resolution assigned to the RGB signals in the first RGB allocation information memory, wherein the screen display unit may further comprise: first DA converters that have a low resolution corresponding to the resolution of the first RGB allocation information memory, and are installed in correspondence to the RGB signals, and that convert the digital RGB allocation information read from the first RGB allocation information memory into analog information; a second DA converter that has a high resolution corresponding to the resolution of the second RGB allocation information memory, and that converts digital RGB allocation information read from the second RGB allocation information memory into analog information; and a fourth selector for selecting one of the analog information output from the first DA converters and the analog information output from the second DA converter in response to fourth selection information fed from the central processing unit.

The RGB allocation information memories may comprise: a first RGB allocation information memory in which equal resolution is assigned to respective RGB signals for storing the RGB allocation information; and a second RGB allocation information memory in which the RGB allocation information is monochromatic, and has a higher resolution than the resolution assigned to the RGB in the first RGB allocation information memory, wherein the screen display unit may further comprise: first DA converters that have a low resolution corresponding to the resolution of the first RGB allocation information memory, and are installed in correspondence to the RGB, and that convert the digital RGB allocation information read from the first RGB allocation information memory into analog information; a second DA converter that has a high resolution corresponding to the resolution of the second RGB allocation information memory, and that converts digital RGB allocation information read from the second RGB allocation information memory into analog information; and a fourth selector for selecting one of the analog information output from the first DA converters and the analog information output from the second DA converter on a character information by character information basis in response to the selection information read from the display information memory.

The screen display unit may further comprise: first DA converters that have a low resolution corresponding to a resolution of the first RGB allocation information memory, and are installed in correspondence to the RGB, and that convert the digital RGB allocation information selected by the selector into analog information; a second DA converter that has a high resolution corresponding to a resolution of the font information memory, and that converts the display color information read from the font information memory into analog information; and a fourth selector for selecting one of the analog information output from the first DA converters and the analog information output from the second DA converter in response to fourth selection information fed from the central processing unit.

The screen display unit may further comprise: first DA converters that have a low resolution corresponding to a resolution of the first RGB allocation information memory, and are installed in correspondence to the RGB, and that convert the digital RGB allocation information selected by the selector into analog information; a second DA converter that has a high resolution corresponding to a resolution of the font information memory, and that converts the display color information read from the font information memory into analog information; and a fourth selector for selecting one of the analog information output from the first DA converters and the analog information output from the second DA converter on a character information by character information basis in response to the selection information read from the display information memory.

According to a third aspect of the present invention, there is provided a screen display unit comprising: a display information memory to which a central processing unit writes selection information corresponding to character information; a font data memory that stores font information and display color information corresponding to the character information in advance, and reads the display color information constituting the font information corresponding to the character information read from the display information memory; an RGB allocation information memory that stores RGB allocation information corresponding to the display color information in advance, and reads RGB allocation information corresponding to the display color information read from the font data memory; a plurality of DA converters that have different analog output characteristics, and that convert digital RGB allocation information read from the RGB allocation information memory into analog information; a selector for selecting the analog information output from one of the plurality of DA converters on a character information by character information basis in response to selection information read from the display information memory; and a timing signal generator for generating timing signals supplied to the display information memory, the font data memory, the RGB allocation information memory, the plurality of DA converters and the selector.

The plurality of DA converters and the selector may comprise: a plurality of resistors having different resistances; a selector for selecting at least one of the resistors to which a reference power source is supplied in response to the selection information; and an R, 2R ladder network for converting the digital RGB allocation information to the analog information in response to the reference power source divided by the resistor selected by the selector.

The plurality of DA converters and the selector may be installed for each of the RGB, wherein the selector may select for each of the RGB the analog information output from the plurality of DA converters in response to the selection information.

The screen display unit may further comprise: a plurality of DA converters that have different analog output characteristics, and convert digital RGB allocation information selected by the selector into analog information; a control circuit for latching fifth selection information in synchronization with a timing signal generated by the timing signal generator, the fifth selection information being supplied from the central processing unit for selecting one of the plurality of DA converters; and a fifth selector for selecting analog information output from one of the plurality of DA converters in response to the fifth selection information held by the control circuit.

DETAILED DESCRIPTION OF THE PREFERRED EMBODIMENTS

The invention will now be described with reference to the accompanying drawings.

Embodiment 1

Figure 1:
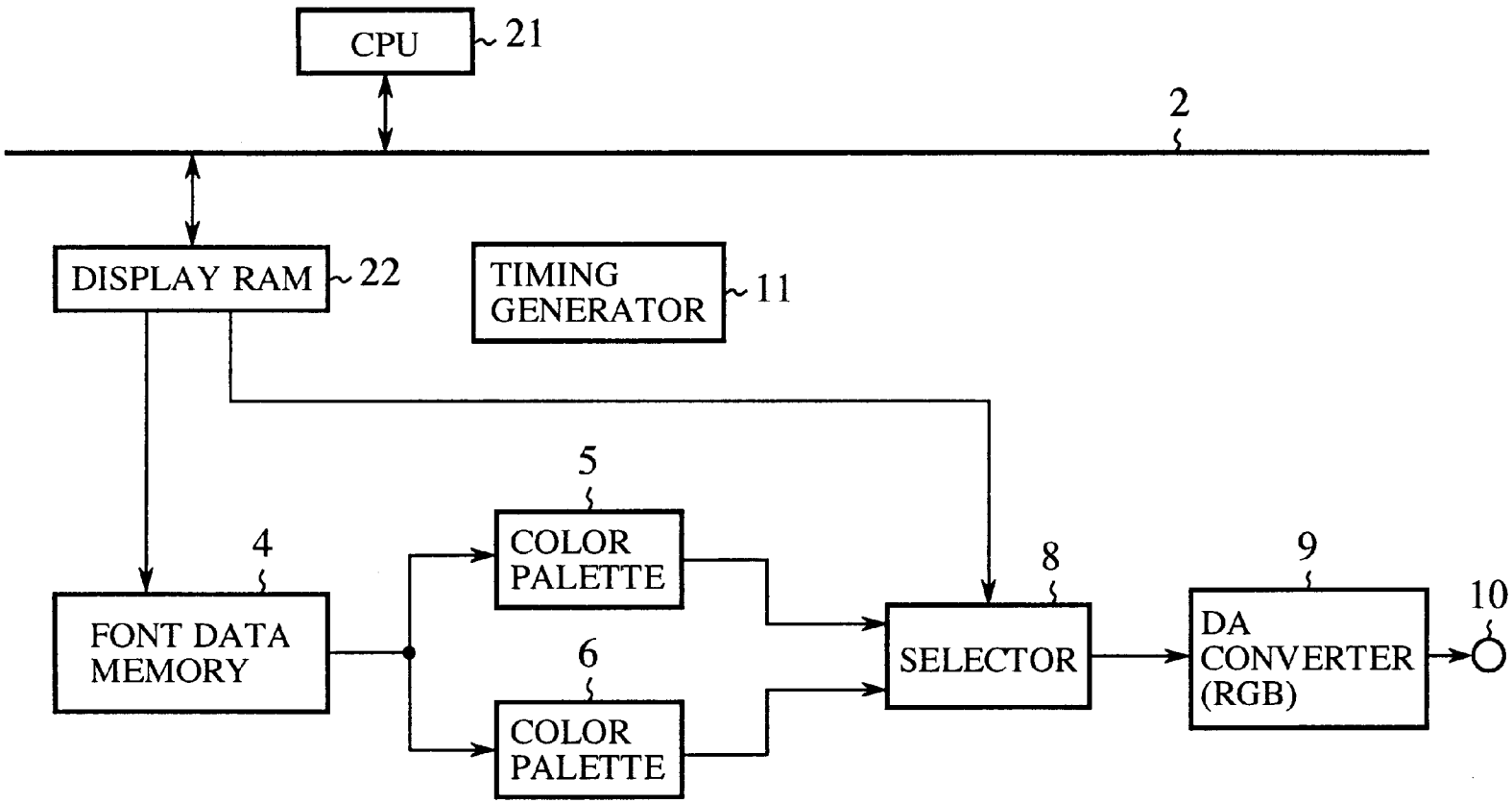
FIG. 1 is a block diagram showing a configuration of an embodiment 1 of the screen display unit in accordance with the present invention.

FIG. 1 is a block diagram showing a configuration of an embodiment 1 of the screen display unit in accordance with the present invention. In this figure, the reference numeral 21 designates a CPU (central processing unit) for writing character codes (character information) and palette codes (selection information) corresponding to the character codes to a display RAM 22 which will be described below; and 2 designates a data and address bus.

The reference numeral 22 designates a display RAM (display information memory) to which the CPU 21 writes character codes and palette codes corresponding to the character codes to be displayed at individual positions of a screen consisting of n row by m column character array.

When the character codes each consist of eight bits and the palette codes each consist of one bit, they are assigned to the display RAM 22 as follows.

| character code<br>first byte<br>b7 - b0 | palette code<br>second byte<br>b0 |
|---|---|

It is also possible to increase the bit length of the palette codes to more than one bit, thereby increasing selectable palette types.

The reference numeral 4 designates a font data memory that stores in advance font patterns (font information) corresponding to the character codes and display color codes (display color information) of individual dots constituting the font patterns, and that reads the display color codes constituting the font patterns corresponding to character codes read from the display RAM 22. The reference numeral 5 designates a color palette (RGB allocation information memory) that stores the display color data (RGB allocation information) corresponding to the display color codes in advance, and reads the display color data corresponding to the display color codes read from the font data memory 4; and 6 designates a color palette (RGB allocation information memory) that stores in advance display color data which correspond to the display color codes and differ from the display color data in the color palette 5, and that reads the display color data corresponding to the display color codes read from the font data memory 4.

The reference numeral 8 designates a selector for selecting the display color data that is read from the palette 5 or 6 in response to the palette codes read from the display RAM 22; 9 designates DA converters provided for individual RGB signals for converting the digital display color data selected by the selector 8 to analog voltages; and 10 designates an output terminal provided for the individual RGB signals. The reference numeral 11 designates a timing generator for generating, from the horizontal and vertical synchronization signals and a screen display clock signal, timing signals which are supplied to the components from the display RAM 22 to the DA converter 9, and are needed for the screen display control.

Next, the operation of the present embodiment 1 will be described.

In the screen display unit as shown in FIG. 1, the CPU 21 writes a character code array to be displayed and the palette codes indicating which one of the color palettes 5 and 6 is to be selected into the display RAM 22 via the bus 2 in advance. Here, the operation clock signal of the CPU 1 is slower than the timing signals, and asynchronous to the timing signals that are generated by the timing generator 11 to operate the components from the display RAM 22 to the DA converter 9.

The display RAM 22 reads the character codes written in synchronization with the timing signals and the palette codes corresponding to the character codes, and supplies the character codes to the font data memory 4 and the palette codes to the selector 8. The font data memory 4 reads the display color codes of the individual dots constituting the font patterns corresponding to the character codes. The color palettes 5 and 6 store different display color data in advance, and read the display color data corresponding to the display color codes that are read from the font data memory 4.

The selector 8 selects the display color data read from the palette 5 or 6 on a character by character basis in response to the palette codes read from the display RAM 22. The DA converters 9 convert the digital display color data selected by the selector 8 into analog voltages to be supplied to the output terminal 10.

As described above, the present embodiment 1 can select one of the two color palettes 5 and 6 on a character by character basis. Thus, it can display greater number of colors than that indicatable by the display color codes stored in the font data memory 4 within the same screen without increasing the capacity of the font data memory 4.

Although the present embodiment 1 comprises the two color palettes, it can comprise three or more color palettes that store different display color data in advance to be selected by the selector 8.

Embodiment 2

Figure 2:
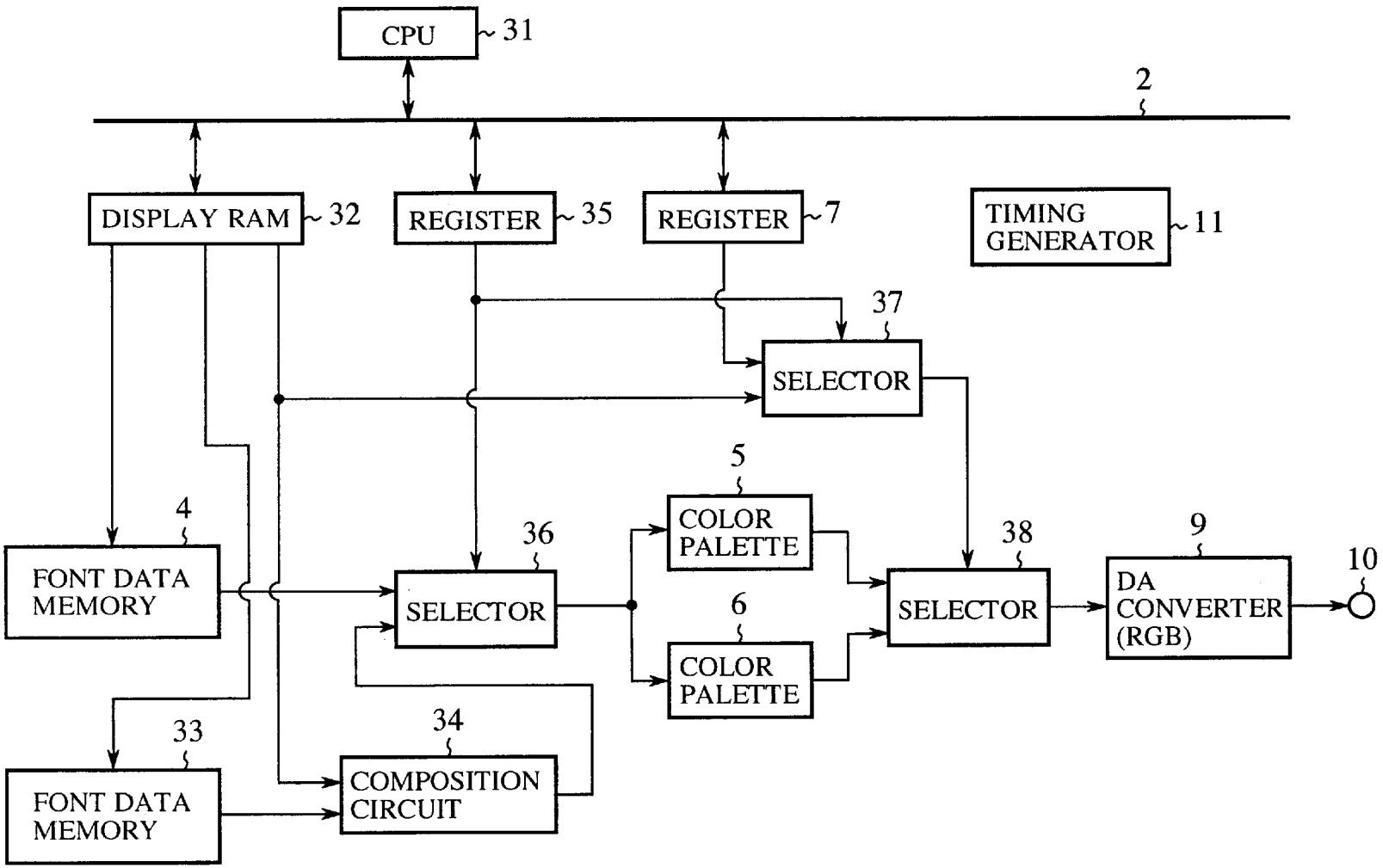
FIG. 2 is a block diagram showing a configuration of an embodiment 2 of the screen display unit in accordance with the present invention.

FIG. 2 is a block diagram showing a configuration of an embodiment 2 of the screen display unit in accordance with the present invention. In this figure, the reference numeral 31 designates a CPU (central processing unit) that writes into a display RAM 32, character codes and palette codes (first selection information) corresponding to the character codes, and/or character codes and display color codes corresponding to the character codes, and that writes into a register 35 control data (second selection information) indicating which one of the font data memory 4 and font data memory 33 is to be selected, and writes into a register 7 control data (third selection information) indicating which one of the color palettes 5 and 6 is to be selected.

The reference numeral 32 designates the display RAM (display information memory) corresponding to the screen consisting of an n row by m column character array. When the CPU 31 selects the font data memory 4, it writes into the display RAM 32 character codes and palette codes corresponding to the character codes to be displayed at individual positions. On the other hand, when it selects the font data memory 33, it writes into the display RAM 32 character codes and display color codes corresponding to the character codes to be displayed at individual positions.

When the character codes each consist of eight bits, the palette codes each consist of one bit and the display color codes each consist of four bits, they are assigned to the display RAM 32 as follows.

| | |
|---|---|
| character code | palette code (b0) *1 |
| character code | display color code *2 |
| first byte | second byte |
| b7 - b0 | b4 - b0 |

where *1 is the case where the font data memory 4 is selected and *2 is the case where the font data memory 33 is selected.

The reference numeral 4 designates the font data memory (first font data memory) that reads the display color codes of individual dots as the font data memory 4 of FIG. 1. The reference numeral 33 designates the font data memory (second font data memory) that stores font patterns corresponding to the character codes in advance, and reads the font patterns corresponding to the character codes read from the display RAM 32. In the font data memory 33, the display color codes of individual dots each consist of one bit, indicating only the presence or absence of the dot without indicating its color.

The reference numeral 34 designates a composition circuit for combining the font patterns read from the font data memory 33 with the display color codes read from the display RAM 32 in such a manner that all the dots in one font pattern take the same display color code, thereby producing the display color codes on a font pattern basis.

The reference numeral 36 designates a selector (first selector) for selecting the display color codes supplied from the font data memory 4 or from the composition circuit 34 in response to the control data written in the register 35; 37 designates a selector (second selector) for selecting the palette codes read from the display RAM 32 or the control data written into the register 7 in response to the control data written into the register 35; and 38 designates a selector (third selector) for selecting, when the selector 37 selects the palette codes, the display color data read from the palette 5 or 6 on a character code by character code basis, and for selecting, when the selector 37 selects the control data written into the register 7, the display color data read from the palette 5 or 6 on a screen by screen basis.

The remaining configuration is the same as that of FIG. 1, and the timing generator 11 generates the timing signals for the components from the display RAM 32 to the DA converter 9.

Next, the operation of the present embodiment 2 will be described.

In the screen display unit as shown in FIG. 2, the CPU 31 writes into the display RAM 32 the character codes and the palette codes corresponding to the character codes, and/or the character codes and the display color codes corresponding to the character codes. In addition, it writes the control data indicating which one of the font data memories 4 and 33 is to be selected into the register 35, and the control data indicating which one of the color palettes 5 and 6 is to be selected into the register 7.

When the control data indicating to select the font data memory 4 is written into the register 35, the display color codes of individual dots, which are read from the font data memory 4, are supplied to the color palettes 5 and 6 via the selector 36 so that they read the display color data corresponding to the color display codes. In parallel with this, the selector 37 causes the selector 38 to select the display color data read from the palette 5 or 6 on a character code by character code basis in response to the palette codes corresponding to the character codes read from the display RAM 32. Thus, the present embodiment 2 can carry out the display on a character code by character code basis using the display color codes for individual dots as in the foregoing embodiment 1.

When the control data indicating to select the font data memory 33 is written into the register 35, the display RAM 32 reads the character codes along with the display color codes corresponding to the character codes, and supplies the character codes to the font data memory 33, and the display color codes to the composition circuit 34.

The font data memory 33 reads the font patterns that correspond to the character codes and have information only about the presence or absence of the dots. The composition circuit 34 combines the font patterns read from the font data memory 33 with the display color codes read from the display RAM 32 so that all the dots in one font pattern take the same display color codes, thereby producing the display color codes on a font pattern by font pattern basis.

The color palettes 5 and 6 reads the display color data corresponding to the display color codes supplied via the selector 36. The selector 38 selects the display color data read from the palette 5 or 6 in response to the control data written into the register 7 by the CPU 31 on a screen by screen basis under the control of the selector 37. Thus, the present embodiment 2 can carry out the display on a screen by screen basis with the display color codes produced for individual font patterns.

As described above, the present embodiment 2 can select one of the two color palettes 5 and 6 on a character by character basis when the font data memory 4 is selected by the control data written into the register 35 by the CPU 31. Thus, it can display greater number of colors than the number of colors indicatable by the display color codes corresponding to the respective dots constituting the font patterns stored in the font data memory 4 within the same screen without increasing the capacity of the font data memory 4.

Besides, when the font data memory 33 is selected by the control data written into the register 35 by the CPU 31, one of the color palettes 5 and 6 is selected on a screen by screen basis. Thus, the present embodiment 2 can carry out the display with the display color codes according to the respective font patterns stored in the font data memory 33.

Embodiment 3

Figure 3:
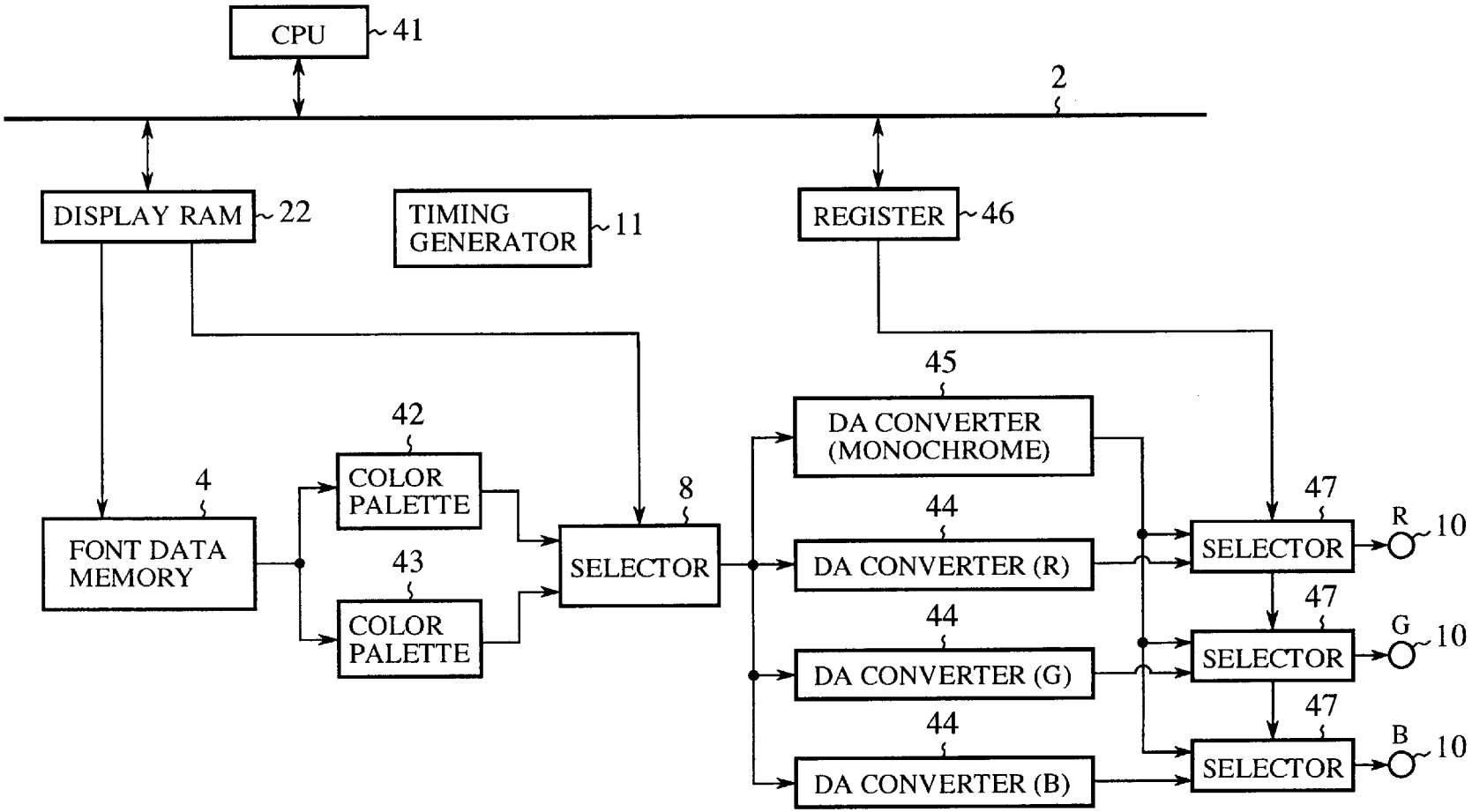
FIG. 3 is a block diagram showing a configuration of an embodiment 3 of the screen display unit in accordance with the present invention.

FIG. 3 is a block diagram showing a configuration of an embodiment 3 of the screen display unit in accordance with the present invention. In this figure, the reference numeral 41 designates a CPU having a function to write into a register 46 control data (fourth selection information) for selecting either a set of three DA converters 44 or a DA converter 45 in addition to the functions of the CPU 21 as shown in FIG. 1.

The reference numeral 42 designates a color palette (first RGB allocation information memory) for storing the display color data with the same resolution for the RGB signals. When the bit length of the display color data output from the color palette 42 is nine bits, they are allocated as follows.

| | |
|---|---|
| b0, b1 and b2 | control 3-bit DA converter 44 for R |
| b3, b4 and b5 | control 3-bit DA converter 44 for G |
| b6, b7 and b8 | control 3-bit DA converter 44 for B |

The three DA converters 44, each of which is installed for one of the RGB signals and controlled by the three bits, can implement the total of 512 colors.

The reference numeral 43 designates a color palette (second RGB allocation information memory) that stores monochrome display color data whose resolution is higher than the RGB resolution of the color palette 42. The bits of the display color data output from the color palette 43 are allocated as follows.

| | |
|---|---|
| b0, b1, b2 and b3 | control 4-bit DA converter 45 |
| b4–b8 | unused |

Reference numerals 44 designate the DA converters (first DA converters) that have lower resolution corresponding to the resolution of the color palette 42, and are installed in correspondence with the RGB signals; the reference numeral 45 designates the DA converter (second DA converter) having higher resolution corresponding to the resolution of the color palette 43. For example,

| | |
|---|---|
| DA converter 44 | 3-bit resolution |
| DA converter 45 | 4-bit resolution |

The reference numeral 46 designates a register into which the CPU 41 writes control data (fourth selection information) for selecting the DA converters 44 or the DA converter 45. When the register 46 consists of one bit, selectors 47 switches the three DA converters 44 at the same time, whereas when it consists of three bits, the selectors 47 can switch them for the RGB signals independently.

The reference numeral 47 designates the selectors (fourth selector) for selecting analog voltages output from the DA converters 44 or the DA converter 45 in response to the control data written into the register 46, and for supplying them to three output terminals 10 provided for the RGB signals, respectively.

Next, the operation of the present embodiment 3 will be described.

When the CPU 41 writes the palette codes for selecting the color palette 42 into the display RAM 22 in the screen display unit as shown in FIG. 3, it also writes the control data for selecting the DA converters 44 into the register 46.

The color palette 42 reads 3-bit display color data for the respective RGB signals in response to the display color codes, and the selector 8 selects the display color data read from the color palette 42. The DA converters 44 convert the digital display color data into analog voltages for the RGB signals at the resolution of 3 bits. The selectors 47 select the analog voltages of the DA converters 44 in response to the control data written into the register 46, and outputs them to the RGB output terminals 10. In this mode, the maximum number of display colors is 512, and the maximum number of gray levels of the monochrome is eight.

In contrast, when the CPU 41 writes the palette code for selecting the color palette 43 into the display RAM 22, it also writes the control data for selecting the DA converter 45 into the register 46.

The color palette 43 reads the display color data of the 4-bit monochrome in response to the display color codes, and the selector 8 selects the display color data read from the color palette 43. The DA converter 45 converts the display color data of the digital monochrome into analog voltages at the resolution of four bits. The selectors 47 selects the analog voltages output from the DA converter 45 in response to the control data written in the register 46, and outputs them to the RGB output terminals 10. In this mode, the display color is monochrome with the luminance of 16 gradations.

Changing the connection between the DA converter 45 and the RGB output terminals 10 by the register 46 and selector 47 makes it possible to select the monochrome from eight colors. For example, connecting all the RGB output terminals 10 to the DA converter 45 makes it possible to display 16-gray-level monotone.

Although the selectors 47 select the analog voltages output from the DA converters 44 or the DA converter 45 in response to the control data written into the register 46 in the present embodiment 3, they can select the analog voltages output from the DA converters 44 or the DA converter 45 in response to the palette codes read from the display RAM 22. In this case, the present embodiment 3 can select either the monotone characters with the high level gradation or the color characters on a character by character basis to be displayed.

As described above, the present embodiment 3 can select either the monotone characters with the high level gradation or the color characters, and display them.

To display a monochrome picture, a higher level gray scale is often required rather than the number of colors. The present embodiment 3 can increase the levels of the gray scale in such cases, thereby improving the expressive power of the screen display unit.

Embodiment 4

Figure 4:
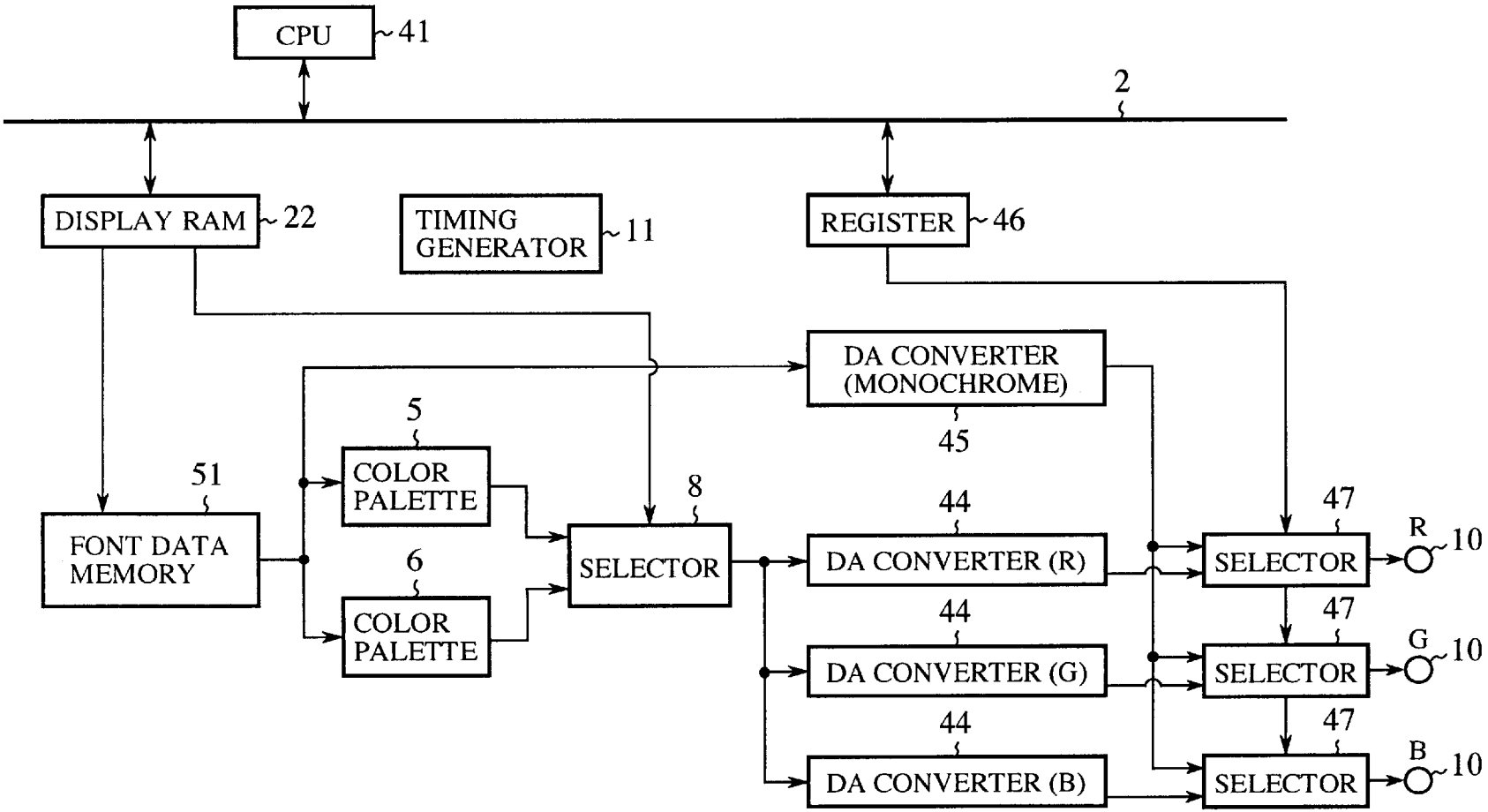
FIG. 4 is a block diagram showing a configuration of an embodiment 4 of the screen display unit in accordance with the present invention.

FIG. 4 is a block diagram showing a configuration of an embodiment 4 of the screen display unit in accordance with the present invention. In this figure, the reference numeral 51 designates a font data memory with higher resolution than the color palettes 5 and 6. For example, when the color palettes 5 and 6 have 3-bit resolution for each of the RGB, it has 4-bit resolution and reads the display color codes. The output of the font data memory 51 is supplied to the DA converter 45 as well as to the color palettes 5 and 6.

The remaining configuration is the same as that of FIG. 3.

Next, the operation of the present embodiment 4 will be described.

When the CPU 41 writes the control data for selecting the DA converters 44 into the register 46 in the screen display unit as shown in FIG. 4, the present embodiment 4 operates just as the foregoing embodiment 3.

In contrast, when the CPU 41 writes the control data for selecting the DA converter 45 into the register 46, the DA converter 45 converts the display color codes with the resolution of four bits read from the font data memory 51 into analog voltages. In addition, in response to the control data written into the register 46, the selectors 47 select the analog voltages output from the DA converter 45, and supply them to the RGB output terminals 10.

Although the selectors 47 select the analog voltages output from the DA converters 44 or the DA converter 45 in response to the control data written into the register 46 in the present embodiment 4, they can select the analog voltages output from the DA converters 44 or the DA converter 45 in response to the palette codes read from the display RAM 22. In this case, the present embodiment 4 can select either the monotone characters with the high level gradation or the color characters on a character by character basis to be displayed.

As described above, the present embodiment 4 can select either the monotone characters with the high level gradation or the color characters, and display them.

To display a monochrome picture, a higher level gray scale is often required rather than the number of colors. The present embodiment 4 can increase the levels of the gray scale in such cases, thereby improving the expressive power of the screen display unit.

Embodiment 5

Figure 5:
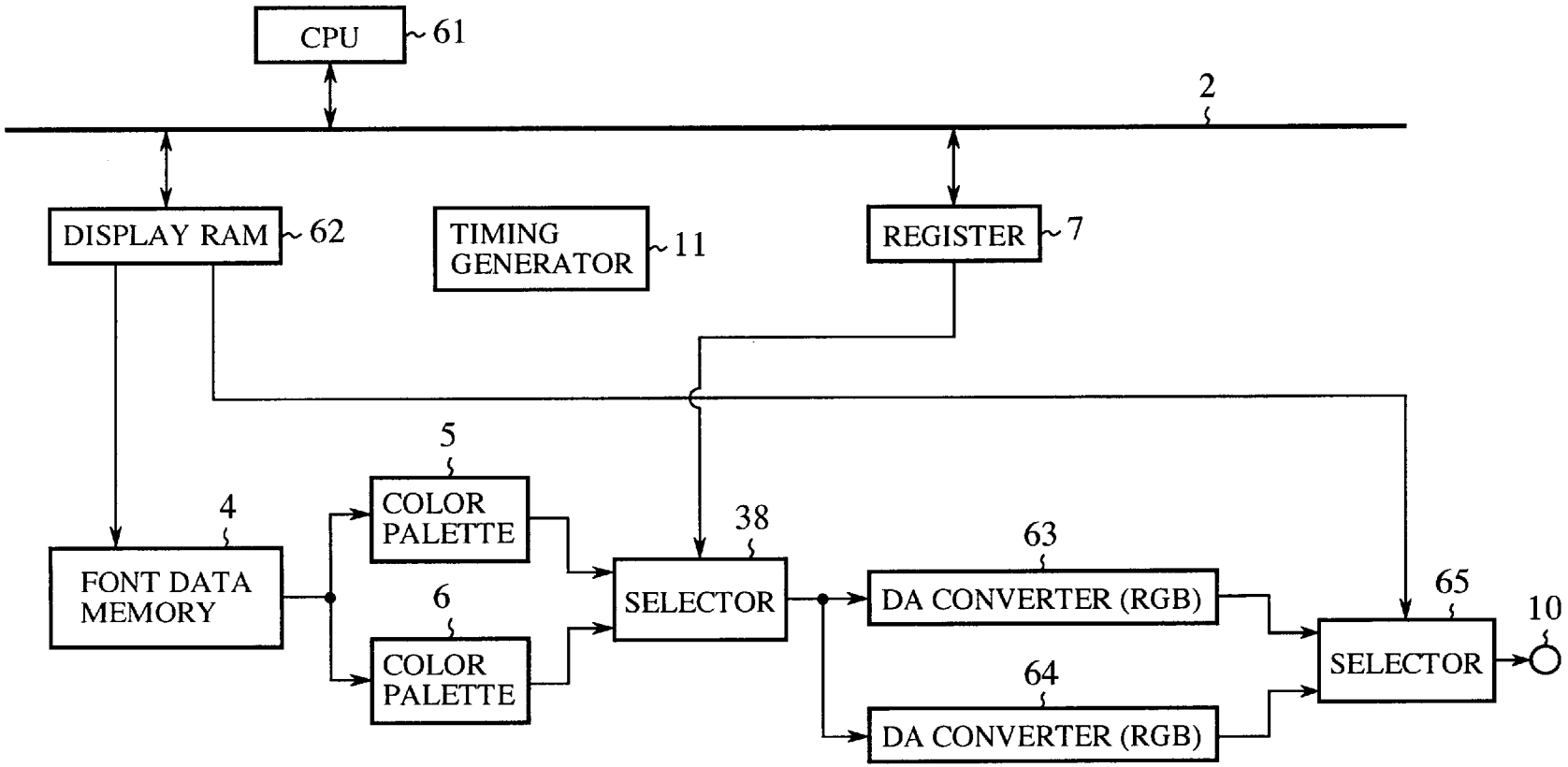
FIG. 5 is a block diagram showing a configuration of an embodiment 5 of the screen display unit in accordance with the present invention.

FIG. 5 is a block diagram showing a configuration of an embodiment 5 of the screen display unit in accordance with the present invention. In this figure, the reference numeral 61 designates a CPU for writing character codes and DA selection codes (selection information) corresponding to the character codes into a display RAM 62.

The reference numeral 62 designates the display RAM (display information memory) into which the CPU 61 writes the character codes to be displayed at the individual positions and the DA selection codes corresponding to the character codes. When the DA selection codes consist of one bit, a selector 65 switches the RGB at the same time, whereas when the DA selection codes consist of three bits, the selector 65 switches the RGB separately.

Reference numerals 63 and 64 each designates DA converters with different analog output characteristics, for converting the digital display color data selected by the selector 38 into the analog voltages.

output voltage of DA converter 63: 0–5 V output voltage of DA converter 64: 0–3 V The reference numeral 65 designates the selector for selecting the analog voltages output from the DA converters 63 or 64 on a character code by character code basis in response to the DA selection codes read from the display RAM 62.

The remaining configuration is the same as that of FIGS. 1 and 2.

Next, the operation of the present embodiment 5 will be described.

In the screen display unit as shown in FIG. 5, the CPU 61 writes the character codes and the DA selection codes corresponding to the character codes into the display RAM 62.

The operation of the font data memory 4 and color palettes 5 and 6 is the same as that of the embodiment 1, and the operation of the register 7 and selector 38 is the same as that of the embodiment 2.

In addition, the DA converters 63 and 64, which have different analog output characteristics, convert the digital display color data selected by the selector 38 into different analog voltages. The selector 65 selects the analog voltages output from the DA converters 63 or 64 on a character code by character code basis in response to the DA selection codes read from the display RAM 62.

As described above, the present embodiment 5 can select either the DA converters 63 or 64 with different analog output characteristics on a character code by character code basis. Thus, it can carry out its display with varying the color tones on the same screen by a greater number of colors than the number of colors indicatable by the display color codes stored in the font data memory 4, without increasing the capacity of the font data memory 4.

Besides, it can easily make such modification as displaying characters to be emphasized in a brighter mode in part on the same screen.

Although only two DA converters are provided in the present embodiment 5, three or more DA converters with different analog output characteristics can be installed to be selected by the selector 65.

Embodiment 6

Figure 6:
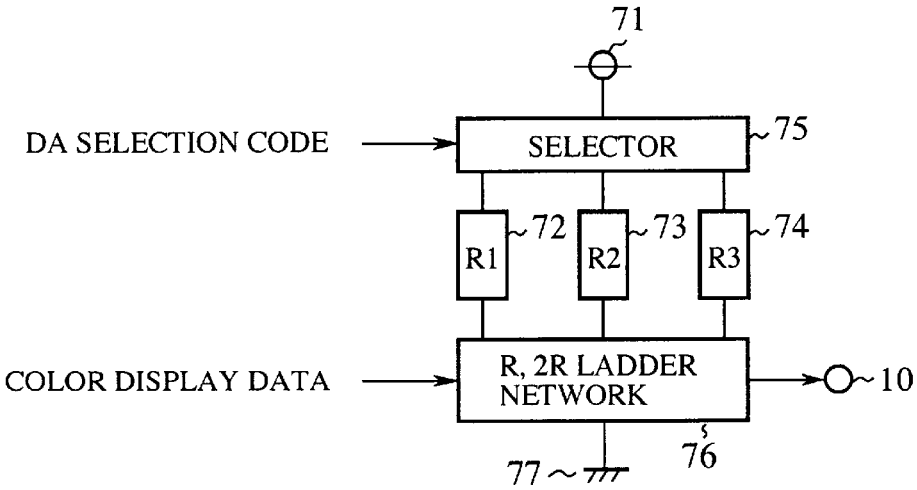
FIG. 6 is a block diagram showing a configuration of a DA converter and a selector of an embodiment 6 of the screen display unit in accordance with the present invention.

FIG. 6 is a block diagram showing a configuration of a DA converter and a selector of an embodiment 6 of the screen display unit in accordance with the present invention, which shows a configuration of both the DA converters 63 and 64 and the selector 65 in more detail. In this figure, the reference numeral 71 designates a reference power source; reference numerals 72–74 designate a plurality of resistors with different resistance; the reference numeral 75 designates a selector corresponding to the selector 65 for selecting at least one of the resistors 72–74 to which the reference power source is to be supplied in response to the DA selection codes; 76 designates a commonly used R, 2R ladder network for converting the digital display color data to the analog voltages in accordance with the reference power source 71 passing through the voltage division by the resistors 72–74 selected by the selector 75; and 77 designates a ground.

Next, the operation of the present embodiment 6 will be described.

In the DA converter and selector as shown in FIG. 6, the selector 75 selects at least one of the resistors 72–74 to which the reference power source is to be supplied in response to the DA selection codes. The R, 2R ladder network 76 converts the digital display color data into the analog voltages in response to the reference power source 71 undergoing the voltage division by the resistors 72–74 selected by the selector 75.

As described above, the present embodiment 6 can implement the plurality of DA converters 63 and 64 and the selector 65 in a small size.

Embodiment 7

Figure 7:
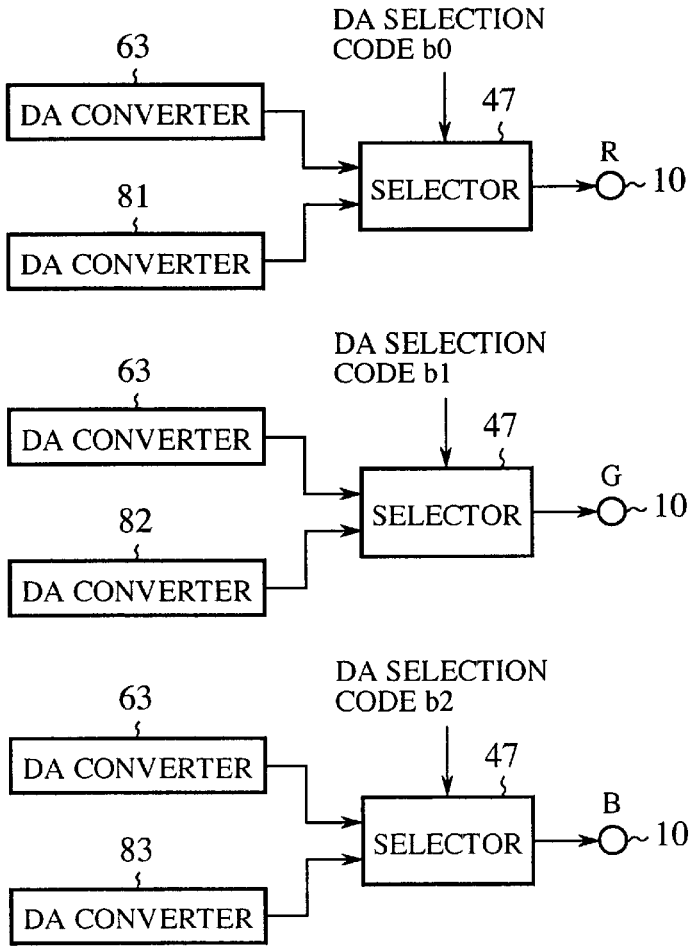
FIG. 7 is a block diagram showing a configuration of DA converters and selectors of an embodiment 7 of the screen display unit in accordance with the present invention.

FIG. 7 is a block diagram showing a configuration of DA converters and selectors of an embodiment 7 of the screen display unit in accordance with the present invention. In this figure, reference numerals 81–83 designate DA converters that are installed in correspondence with the RGB, and have different analog output characteristics.

The selectors 47 select the analog voltages that are output from the DA converter 63 or DA converter 81, the DA converter 63 or DA converter 82, and the DA converter 63 or DA converter 83 for the RGB, respectively, in response to 3-bit DA selection codes b0(R), b1(G) and b2(B).

Next, the operation of the present embodiment 7 will be described.

In the DA converters and selectors as shown in FIG. 7, the DA converters 81–83 with different analog output characteristics are connected in parallel with the DA converters 63 with the same analog output characteristic, respectively, and the selectors 47 select the analog voltages that are output from the DA converter 63 or DA converter 81, the DA converter 63 or DA converter 82, and the DA converter 63 or DA converter 83 for the RGB, respectively, in response to the 3-bit DA selection codes b0(R), b1(G) and b2(B).

As described above, the present embodiment 7 can vary the color tone of the RGB independently, thereby improving its expressive power.

Embodiment 8

Figure 8:
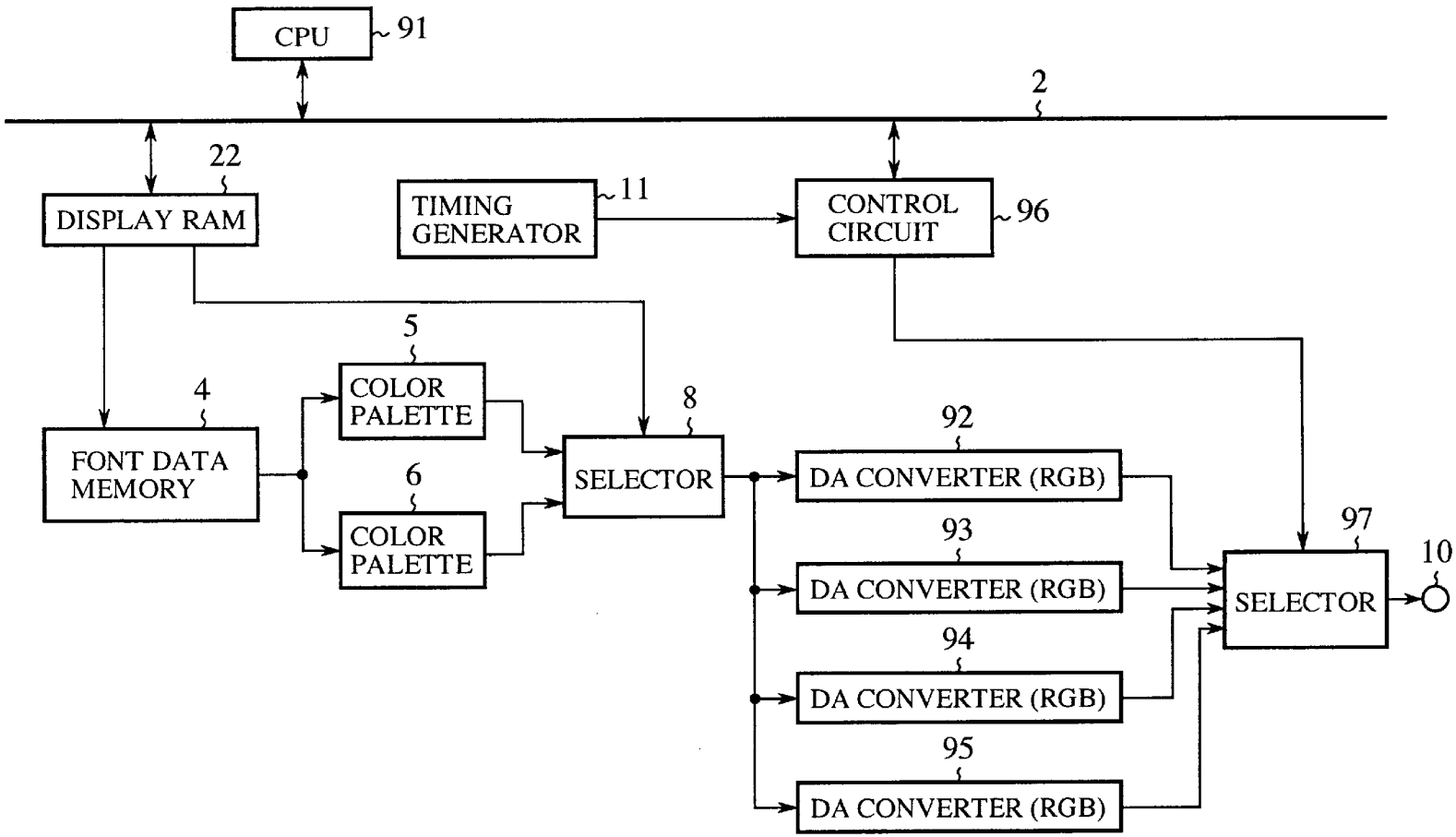
FIG. 8 is a block diagram showing a configuration of an embodiment 8 of the screen display unit in accordance with the present invention.
Figure 9:
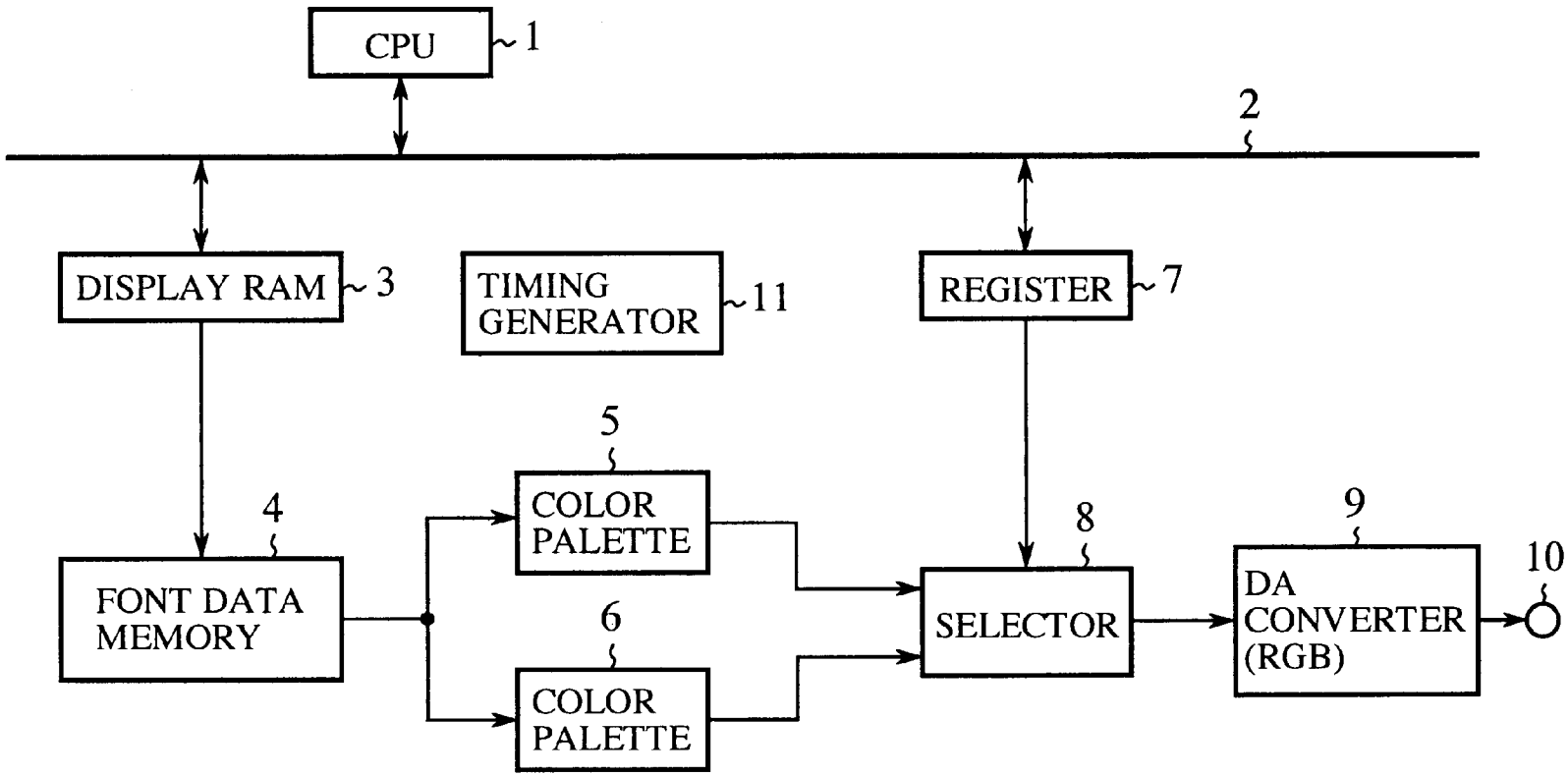
FIG.9 (PRIOR ART)
FIG. 9 is a block diagram showing a configuration of a conventional screen display unit.

FIG. 8 is a block diagram showing a configuration of an embodiment 8 of the screen display unit in accordance with the present invention. In this figure, the reference numeral 91 designates a CPU for writing into a control circuit 96 switching data (fifth selection information) for selecting one of four sets of DA converters 92–95; and reference numerals 92–95 designate the plurality of DA converters with different analog output characteristics.

output voltages of DA converters 92: 0–5 V output voltages of DA converters 93: 0–4 V output voltages of DA converters 94: 0–3 V output voltages of DA converters 95: 0–2 V The reference numeral 96 designates the control circuit for latching the switching data fed from the CPU 91 in synchronization with a timing signal generated by the timing generator 11. The reference numeral 97 designates a selector (fifth selector) for selecting the analog voltages fed from the DA converters 92–95 in response to the latched switching signal.

| Latch data | Switching signal |
|---|---|
| 000 | Select DA converters 92 |
| 001 | Select DA converters 93 |
| 010 | Select DA converters 94 |
| 011 | Select DA converters 95 |
| 100 | Switch from DA converters 92 to DA converters 93 in synchronization with vertical sync signal. |
| 101 | Switch from DA converters 93 to DA converters 92 in synchronization with vertical sync signal. |

-continued

| Latch data | Switching signal |
|---|---|
| 110 | Switch from DA converters 92 to DA converters 93 in synchronization with multiple periods of vertical sync signal. |
| 111 | Switch from DA converters 93 to DA converters 92 in synchronization with multiple periods of vertical sync signal. |

Next, the operation of the present embodiment 8 will be described.

In the screen display unit as shown in FIG. 8, the CPU 91 writes the switching data for selecting the DA converters 92–95 into the control circuit 96. The DA converters 92–95 convert the digital display color data to the analog voltages with the different analog output characteristics.

The control circuit 96 latches the switching data for the selection fed from the CPU 91 in synchronization with the timing signal generated by the timing generator 11. In response to the switching signal latched, the selector 97 selects the analog voltages fed from the DA converters 92–95 and supply them to the output terminal 10.

As described above, the present embodiment 8 can vary its brightness of display characters with the elapse of the time in such a manner that the characters gradually increase or decrease their brightness in response to the switching data from the CPU 91.

What is claimed is:

1. A screen display unit comprising:

a display information memory to which a central processing unit writes first selection information corresponding to character information, and display color information corresponding to the character information;

a first font data memory that stores font information and display color information corresponding to the character information in advance, and reads display color information representing individual dots constituting font information corresponding to the character information read from said display information memory;

a second font data memory that stores font information corresponding to the character information in advance, and reads font information corresponding to the character information read from said display information memory;

a composition circuit for combining the font information read from said second font data memory with the display color information read from said display information memory to output display color information on a font information by font information basis;

a first selector for selecting one of the display color information output from said first font data memory and the display color information output from said composition circuit, in response to second selection information supplied from said central processing unit;

a plurality of RGB allocation information memories that store different RGB allocation information corresponding to the display color information in advance, and read RGB allocation information corresponding to the display color information selected by said first selector;

a second selector for selecting, in response to the second selection information fed from said central processing unit, one of the first selection information that is read from said display information memory and third selection information that is fed from said central processing unit;

a third selector for selecting the RGB allocation information read from said plurality of RGB allocation information memories on a character information by character information basis when said second selector selects the first selection information, and for selecting the RGB allocation information read from said plurality of RGB allocation information memories on a screen by screen basis when said second selector selects the third selection information; and a timing signal generator for generating timing signals supplied to said display information memory, said first and second font data memories, said composition circuit, said first to third selectors, and said plurality of RGB allocation information memories.

2. A screen display unit comprising:

a display information memory to which a central processing unit writes selection information corresponding to character information;

a font data memory that stores display color information corresponding to the character information in advance, and reads display color information constituting font information corresponding to the character information read from said display information memory;

a plurality of RGB allocation information memories that store different RGB allocation information corresponding to the display color information in advance, and read RGB allocation information corresponding to the display color information read from said font data memory;

a selector for selecting the RGB allocation information read from one of said plurality of RGB allocation information memories on a character information by character information basis in response to the selection information read from said display information memory; and a timing signal generator for generating timing signals supplied to said display information memory, said font data memory, said plurality of RGB allocation information memories, and said selector, wherein said RGB allocation information memories comprise:

a first RGB allocation information memory in which equal resolution is assigned to respective RGB signals for storing the RGB allocation information; and a second RGB allocation information memory in which the RGB allocation information is monochromatic, and has a higher resolution than the resolution assigned to the RGB signals in said first RGB allocation information memory, and wherein said screen display unit further comprises:

first DA converters that have a low resolution corresponding to the resolution of said first RGB allocation information memory, and are installed in correspondence to the RGB signals, and that convert the digital RGB allocation information read from said first RGB allocation information memory into analog information;

a second DA converter that has a high resolution corresponding to the resolution of said second RGB allocation information memory, and that converts digital RGB allocation information read from said second RGB allocation information memory into analog information; and a second selector for selecting one of the analog information output from said first DA converters and the analog information output from said second DA converter in response to selection information fed from said central processing unit.

3. A screen display unit comprising:

a display information memory to which a central processing unit writes selection information corresponding to character information;

a font data memory that stores display color information corresponding to the character information in advance, and reads display color information constituting font information corresponding to the character information read from said display information memory;

a plurality of RGB allocation information memories that store different RGB allocation information corresponding to the display color information in advance, and read RGB allocation information corresponding to the display color information read from said font data memory;

a selector for selecting the RGB allocation information read from one of said plurality of RGB allocation information memories on a character information by character information basis in response to the selection information read from said display information memory; and a timing signal generator for generating timing signals supplied to said display information memory, said font data memory, said plurality of RGB allocation information memories, and said selector, wherein said RGB allocation information memories comprise:

a first RGB allocation information memory in which equal resolution is assigned to respective RGB signals for storing the RGB allocation information; and a second RGB allocation information memory in which the RGB allocation information is monochromatic, and has a higher resolution than the resolution assigned to the RGB in said first RGB allocation information memory, and wherein said screen display unit further comprises:

first DA converters that have a low resolution corresponding to the resolution of said first RGB allocation information memory, and are installed in correspondence to the RGB, and that convert the digital RGB allocation information read from said first RGB allocation information memory into analog information;

a second DA converter that has a high resolution corresponding to the resolution of said second RGB allocation information memory, and that converts digital RGB allocation information read from said second RGB allocation information memory into analog information; and a second selector for selecting one of the analog information output from said first DA converters and the analog information output from said second DA converter on a character information by character information basis in response to the selection information read from said display information memory.

4. A screen display unit comprising:

a display information memory to which a central processing unit writes selection information corresponding to character information;

a font data memory that stores display color information corresponding to the character information in advance, and reads display color information constituting font information corresponding to the character information read from said display information memory;

a plurality of RGB allocation information memories that store different RGB allocation information corresponding to the display color information in advance, and read RGB allocation information corresponding to the display color information read from said font data memory;

a selector for selecting the RGB allocation information read from one of said plurality of RGB allocation information memories on a character information by character information basis in response to the selection information read from said display information memory; and a timing signal generator for generating timing signals supplied to said display information memory, said font data memory, said plurality of RGB allocation information memories, and said selector;

first DA converters that have a low resolution corresponding to a resolution of said first RGB allocation information memory, and are installed in correspondence to the RGB, and that convert the digital RGB allocation information selected by said selector into analog information;

a second DA converter that has a high resolution corresponding to a resolution of said font information memory, and that converts the display color information read from said font information memory into analog information; and a second selector for selecting one of the analog information output from said first DA converters and the analog information output from said second DA converter in response to selection information fed from said central processing unit.

5. A screen display unit comprising:

a display information memory to which a central processing unit writes selection information corresponding to character information;

a font data memory that stores display color information corresponding to the character information in advance, and reads display color information constituting font information corresponding to the character information read from said display information memory;

a plurality of RGB allocation information memories that store different RGB allocation information corresponding to the display color information in advance, and read RGB allocation information corresponding to the display color information read from said font data memory;

a selector for selecting the RGB allocation information read from one of said plurality of RGB allocation information memories on a character information by character information basis in response to the selection information read from said display information memory; and a timing signal generator for generating timing signals supplied to said display information memory, said font data memory, said plurality of RGB allocation information memories, and said selector;

first DA converters that have a low resolution corresponding to a resolution of said first RGB allocation information memory, and are installed in correspondence to the RGB, and that convert the digital RGB allocation information selected by said selector into analog information;

a second DA converter that has a high resolution corresponding to a resolution of said font information memory, and that converts the display color information read from said font information memory into analog information; and a second selector for selecting one of the analog information output from said first DA converters and the analog information output from said second DA converter on a character information by character information basis in response to the selection information read from said display information memory.

6. A screen display unit comprising:

a display information memory to which a central processing unit writes selection information corresponding to character information;

a font data memory that stores font information and display color information corresponding to the character information in advance, and reads the display color information constituting the font information corresponding to the character information read from said display information memory;

an RGB allocation information memory that stores RGB allocation information corresponding to the display color information in advance, and reads RGB allocation information corresponding to the display color information read from said font data memory;

a plurality of DA converters that have different analog output characteristics, and that convert digital RGB allocation information read from said RGB allocation information memory into analog information;

a selector for selecting the analog information output from one of said plurality of DA converters on a character information by character information basis in response to selection information read from said display information memory; and a timing signal generator for generating timing signals supplied to said display information memory, said font data memory, said RGB allocation information memory, said plurality of DA converters and said selector.

7. The screen display unit according to claim 6, wherein said plurality of DA converters and said selector comprise:

a plurality of resistors having different resistances;

a selector for selecting at least one of said resistors to which a reference power source is supplied in response to the selection information; and an $R_1 2R$ ladder network for converting the digital RGB allocation information to the analog information in response to the reference power source divided by the resistor selected by said selector.

8. The screen display unit according to claim 6, wherein said plurality of DA converters and said selector are installed for each of the RGB, and wherein said selector selects for each of the RGB the analog information output from said plurality of DA converters in response to the selection information.

9. A screen display unit comprising:

a display information memory to which a central processing unit writes selection information corresponding to character information;

a font data memory that stores display color information corresponding to the character information in advance, and reads display color information constituting font information corresponding to the character information read from said display information memory;

a plurality of RGB allocation information memories that store different RGB allocation information corresponding to the display color information in advance, and read RGB allocation information corresponding to the display color information read from said font data memory;

a selector for selecting the RGB allocation information read from one of said plurality of RGB allocation information memories on a character information by character information basis in response to the selection information read from said display information memory; and a timing signal generator for generating timing signals supplied to said display information memory, said font data memory, said plurality of RGB allocation information memories, and said selector;

a plurality of DA converters that have different analog output characteristics, and convert digital RGB allocation information selected by said selector into analog information; a control circuit for latching fifth selection information in synchronization with a timing signal generated by said timing signal generator, the fifth selection information being supplied from said central processing unit for selecting one of said plurality of DA converters; and a fifth selector for selecting analog information output from one of said plurality of DA converters in response to the fifth selection information held by said control circuit.

* * * * *